United States Patent [19]

Hudd

[11] 4,230,006

[45] Oct. 28, 1980

[54] CONTINUOUS CASTING OF METALS

[75] Inventor: Anthony W. Hudd, Sutton Coldfield, England

[73] Assignee: IMI Refiners Limited, Walsall, England

[21] Appl. No.: 4,192

[22] Filed: Jan. 17, 1979

[30] Foreign Application Priority Data

Jan. 17, 1978 [GB] United Kingdom ..... 1803/78

[51] Int. Cl.[3] ..... B22D 11/126

[52] U.S. Cl. ..... 83/319; 164/263; 83/455

[58] Field of Search ..... 164/263, 441, 442, 447, 164/448; 83/319, 452–466, 320; 269/152, 153, 154, 155, 156

[56] References Cited

U.S. PATENT DOCUMENTS

| | | | |
|---|---|---|---|
| 2,163,967 | 6/1939 | Strawn et al. | 164/263 |
| 3,312,460 | 4/1967 | Kaufman | 269/153 |
| 3,353,818 | 11/1967 | Hill | 83/465 |
| 3,368,240 | 2/1968 | Lister et al. | 269/153 |

FOREIGN PATENT DOCUMENTS

| | | |
|---|---|---|
| 730702 | 5/1952 | United Kingdom . |
| 1208456 | 10/1970 | United Kingdom . |

*Primary Examiner*—Robert D. Baldwin
*Assistant Examiner*—K. Y. Lin
*Attorney, Agent, or Firm*—Cushman, Darby & Cushman

[57] ABSTRACT

A clamp for clamping three strands of continuously cast metal, the three strands lying in a common plane, there being a pair of outer, hydraulic rams adapted to squeeze the strands together, a fixed clamping member between one pair of the strands and a pivotable clamping member between the other pair so that the ram can compress the three strands towards one another for clamping purposes, particularly useful for clamping three continuously cast strands prior to cutting them with a flying saw.

8 Claims, 2 Drawing Figures

1
2
3
3
3
4
5
5
5
5
6
6'
6''
7
7
8
8'
9
9'
51
51'
52
52'
10
11
11'
12
12'
13
14
15
16
17
18
19
20
21
22
23
24
25
26
27
28
29
30
31
32
33
34
35
36
37
38
39
40
41
42
43
44
45
46
47
48
49
50
II
II

CONTINUOUS CASTING OF METALS

BACKGROUND OF THE INVENTION

This invention relates to the continuous casting of metals, especially of copper or copper alloys in the form of billets or slabs.

In one process for the continuous casting of copper slabs or billets, molten copper is continuously fed into a water-cooled, graphite-lined mould from which the cast copper, known as "a strand", issues in a downward direction. The mould is reciprocated vertically during casting to free the moulded copper from the sides of the mould and at the same time the strand is moved downwardly at an appropriate rate, and is supported, by a pair of spring-loaded pinch rolls mounted below the mould on horizontal drive shafts. The strand is then cut, for example by means of a flying saw, into desired lengths typically between 500 and 3 000 mm.

In order that the maximum utilization of equipment is made it is normally advantageous to cast as much material at the same time as can be arranged with the equipment available. Thus the maximum quantity of material can be cast when the strand is in the form of a rectangular cross-sectional slab which has as large a size as possible given the overall dimensions of the machine. In certain cases, however, it is desirable to cast circular cross-sectional strands, normally referred to as billets. The normal method adopted in such an arrangement is to replace the slab mould with a billet mould having two apertures which fit within the cross-section of the largest slab mould so that the billets can be cut by the flying saw normally used to cut the slabs. It is conventionally arranged, with one typical continuous casting machine, that there is provided an assembly comprising four pinch rolls. Two pairs of rolls are used when two strands are being cast simultaneously and only a single pair is used when a slab is being cast. The rolls are movable laterally with respect to the descending strand of cast material and can be forced into contact with the strand or strands to support it and guide it during its downward movement.

In certain circumstances it is required to cast relatively small diameter billets. If small diameter moulds are used then the casting rate is reduced— the casting rate being limited by the solidification rate of the metal within the moulds. Because it is necessary to support each strand with a separate pair of pinch rolls, the present arrangement of continuous casting machines utilising four pinch rolls is limited to casting a maximum of two billets irrespective of the diameter of the billets.

In an article in November 1977 edition of Metallurgist and Materials Technologist we disclose means whereby existing single and twin strand continuous casting machines can relatively quickly and easily be converted into three strand casting machines. As will be appreciated, in addition to modifying the pinch rollers as is disclosed in those applications, it is necessary to modify other parts of the machine, inter alia the mould and the clamp(s) used to clamp the strand(s) while the latter are cut into manageable lengths.

The clamps are conventionally mounted on a flying saw platform, that is to say a platform having mounted on it a horizontal circular saw blade which is moved laterally, while rotating, to cut through the strand or simultaneously through all the strands. At the same time, the platform, and hence the saw, move downwards at a rate equal to the rate of casting of the strand(s). After cutting has been completed, the saw blade is retracted and the platform is raised to its original position in preparation for the next sawing cycle. The clamps serve to clamp the strand(s) rigidly relative to the saw blade during sawing. After sawing, the clamps are released and each strand is fed downwardly to a downender comprising clamps which rotate the strand(s) from a vertical position into a horizontal position. Each strand is then transported away on a conveyor system.

In single strand casting, the clamps conventionally comprise a pair of opposed jaws which, during sawing, are urged under hydraulic pressure into contact with the strand. As already described, a single strand machine can usually readily be modified into a twin strand, for example billet, casting machine. This entails, inter alia, positioning a pair of clamping rolls, whose axes are spatially fixed, between the pair of opposed jaws, the latter, in the case of billet casting, being V-shaped. During sawing, one strand is clamped between one of the jaws and one of the clamping rolls and the other strand between the order of the jaws and the other of the rolls. The clamping force on the strands is, as in the case of single strand casting, determined by the hydraulic force applied to the jaws. Usually, the strand or strands are clamped below and above the saw line by a pair of clamp arrangements, each of the type just described.

For use in continuously casting three strands, for example billets, in a line we have devised a clamp arrangement which can utilise the existing jaws of a single or twin billet sawing device and which ensures that all three strands are adequately clamped during sawing. The arrangement may, however, be constructed to cope with two strands or more than three strands.

SUMMARY OF THE INVENTION

According to the present invention a clamp arrangement for clamping at least two continuously cast metal strands, during cutting thereof into predetermined lengths, comprises a pair of opposed, spaced outer clamping surfaces and positioned between, and spaced from, said outer clamping surfaces at least one pair of intermediate clamping surfaces, said outer and intermediate clamping surfaces defining between them at least two passageways each for vertically receiving one of said strands and at least one pair of intermediate clamping surfaces being constituted by, or attached to, a member that is free to move towards and away from said outer clamping surfaces.

In a preferred embodiment for clamping three strands during cutting which have been continuously cast in a line, there are two pairs of intermediate clamping surfaces, ie there is a total of six clamping surfaces which between them define three passageways for vertically receiving the three strands. In this preferred embodiment, one of the intermediate pairs of clamping surfaces is preferably fixed and the other movable in the manner described-above. The fixed pair of clamping surfaces provides a datum for the arrangement. The clamping action in such a case will be described later with reference to the accompanying drawings.

Accordingly, the present invention especially provides a clamp arrangement for clamping three continuously cast metal strands during cutting thereof into lengths, the arrangement comprising a pair of opposed, laterally movable spaced outer clamping surfaces and positioned between, and spaced from, said outer clamping surfaces a pair of fixed clamping surfaces and a pair of laterally movable clamping surfaces, the arrangement being such that adjacent, opposed pairs of said clamping surfaces each defines a passageway for vertically receiving one of said strands and that lateral movement of said outer clamping surfaces towards one another causes the three strands to be gripped by respective opposed pairs of clamping surfaces.

The movable pair of intermediate clamping surfaces is preferably free to move by virtue of said member being pivotally mounted. The movement will, therefore, strictly be arcuate, but as the required movement will generally be relatively small, the movement can be considered to be substantially linear.

With particular reference to three strand casting, the use of a movable intermediate clamping surface ensures that the central one of the three strands is adequately gripped during cutting without the need for the whole clamping arrangement to be accurately aligned with the downwardly approaching strands.

As has already been mentioned, the outer clamping surfaces may comprise the pair of V-shaped jaws used on existing single and twin billet casting machines. The intermediate clamping surfaces may comprise, for example, the surfaces of clamping rolls. The necessary clamping forces may, for example, be applied by hydraulic means.

In order to ensure that the strands are rigidly clamped during cutting, a clamping arrangement of the invention may be provided above and below the cutting line, e.g. above and below the horizontal plane containing a circular saw blade.

The present invention also provides apparatus for continuously casting a plurality of strands, especially three strands, for example billets of a metal, the apparatus comprising at least one clamp arrangement of the invention for clamping said strands during cutting thereof into predetermined lengths.

BRIEF DESCRIPTION OF THE DRAWINGS

The invention will now be described in more detail, by way of example only, with reference to the accompanying drawings, of which.

DESCRIPTION OF THE PREFERRED EMBODIMENTS

Figure 1:
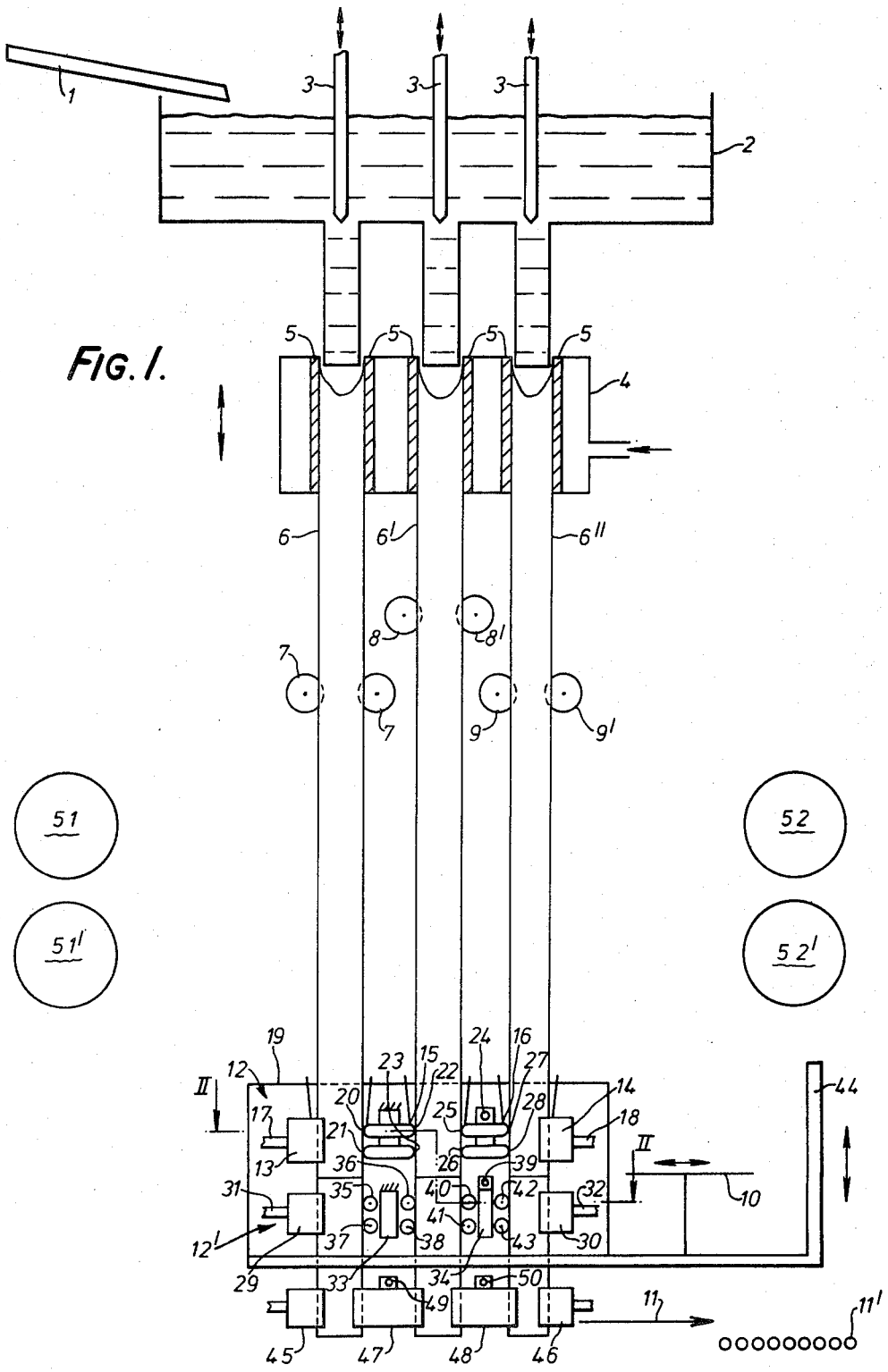
FIG. 1 is a schematic side elevation, partly in section, of three strand continuous casting apparatus including two clamp arrangements of the invention, one below and one above the cutting line.
Figure 2:
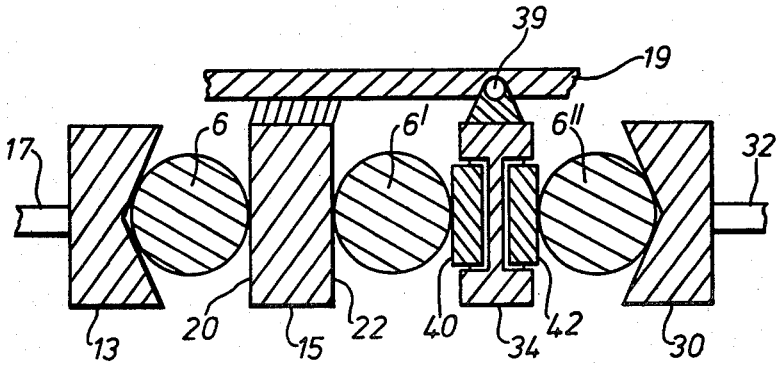
FIG. 2 is a sectional plan view, on an enlarged scale, through the line II—II of FIG. 1.

Referring to FIG. 1 of the drawings, molten copper, for example, is fed in the direction of the arrow down a launder 1 from a melting furnace (not shown) into a holding furnace 2 which includes metal flow control valves 3 for controlling flow of metal into moulds 4. The moulds 4 include graphite liners 5 and are water cooled, the water inlet direction being indicated by the arrow. The moulds 4 are reciprocated in a vertical direction and three cast copper billets 6, 6' and 6'' of circular cross-section issue from the bottom of the moulds 4. As can be seen from FIGS. 1 and 2, the axes of the billets 6, 6' and 6'' lie in a line. The cast billets are moved in a downward direction by three pairs of spring loaded pinch rolls 7, 7', 8, 8' and 9, 9' driven through a gearbox (not shown) and are then cut into desired lengths by a flying saw 10. An example of a preferred arrangement of the pinch rolls is fully described in the article referred to above, the disclosure of which is incorporated herein, and other parts of the apparatus just described will be familiar to those skilled in the art. The cut lengths are rotated into a horizontal direction by a downender indicated by the arrow 11 whence the cut lengths are transported away on a conveyor system 11'.

During cutting of the strands by flying saw 10 (the construction and operation of which also will be familiar to those skilled in the art), the strands are clamped by two clamp arrangements of the invention designated generally by reference numerals 12 and 12'. Each clamp arrangement 12, 12' ensures that the strands cannot move relative to the saw 10 during the cutting operation.

The upper clamp arrangement 12 comprises two outer clamp members 13 and 14, and two intermediate clamp members 15 and 16. The outer members 13 and 14 each comprises a V-shaped jaw movable into and out of clamping engagement with respective billets 6, 6' by hydraulically operated pistons 17 and 18. The members 13 and 14, pistons 17 and 18 and associated hydraulic gear may be items of an existing single/twin strand casting machine. Typically, the hydraulic force applied to each member 13, 14 to clamp the billets in position is of the order of 8,000 lb. Each clamp member is provided with an upper tapered guide to guide the billets into the respective regions between the clamping surfaces. The intermediate member 15 is spatially fixed by being welded to a support member 19, and comprises four radiused clamping surfaces 20, 21, 22 and 23, the surfaces 20 and 21 co-operating with clamp member 13 to clamp billet 6 during a cutting operation. The intermediate member 16 is pivotally mounted at 24 on support member 19 and also comprises four radiused clamping surfaces 25, 26, 27 and 28. Surfaces 25 and 26 co-operate with surfaces 22 and 23 of member 15 to clamp the central billet 6' during a cutting operation, the clamping force on billet 6' being communicated from the member 14 via billet 6'' and pivotally mounted member 16. Surfaces 27 and 28 of member 16 co-operate with member 14 to clamp billet 6''.

The lower clamp arrangement 12' comprises two outer clamp members 29 and 30, each of which comprises a V-shaped jaw movable into and out of clamping engagement with respective billets 6 and 6'' by hydraulically operated pistons 31 and 32. Again these items may be part of an existing single/twin strand casting machine. The lower clamp arrangement 12' also comprises two intermediate clamp members 33 and 34. Member 33 is spatially fixed by being welded to support member 19 and comprises four rollers 35, 36, 37 and 38. Member 34 is pivotally mounted at 39 on support member 19 and also comprises four rollers 40, 41, 42 and 43. The various jaw and roller surfaces co-operate to grip the billets 6, 6' and 6'' in a manner similar to the upper clamp arrangement 12.

If desired, the four intermediate clamp members of arrangements 12 and 12'' may have V- or otherwise-shaped clamping surfaces, but the radiused and roller surfaces described above are preferred as damage to the exterior surface of the billets during clamping and sawing tends to be less than with other forms of clamping surfaces. Further, as mentioned above, the outer V-shaped jaws of arrangements 12 and 12' may be part of an existing single/twin strand casting machine and the two sets of intermediate clamp members may be installed as a unit which renders modification of an existing single/twin strand sawing clamp arrangement to a three strand clamp arrangement, and vice-versa, relatively easy.

As can be seen from FIG. 1, the saw 10 and the clamp arrangements 12 and 12' are mounted on a plateform 44 which is vertically reciprocable (as shown by the double arrow), the platform 44 being moved downwards during a cutting operation, at a rate equal to the casting rate. After the cutting operation, the saw 10 is retracted and the clamp arrangement 12 is released. Continued downward movement of the platform 44 feeds the cut billets, still gripped by clamp arrangement 12', into clamps of the downender 11. The latter clamps comprise two outer hydraulically operated V-shaped jaws 45 and 46 and two intermediate clamp members 47 and 48 each of which comprises two plane clamping surfaces. The members 47 and 48 are pivotally mounted at 49 and 50 respectively to ensure uniform gripping of the billets without the need to ensure accurate alignment of the downender clamps with the cut billets as the latter are downwardly fed to the clamp. As will be appreciated, the arrow 11 indicates a downender device of conventional type which rotates the three billets into a horizontal position and drops them onto the horizontal conveyor system 11'. At the same time, the platform 44 is moved upwardly to its original position in preparation for the next cutting operation.

The rolls 51, 51', 52 and 52' signify the pinch rolls conventionally used in single and twin strand casting and which have been laterally retracted to enable use of the machine to cast three billets simultaneously. The machine shown in FIG. 1 of the drawings may be converted back to single or twin strand casting in the manner described in the article referred to above.

A clamp arrangement of the invention may be adapted to clamp, for example, four strands cast in a line during cutting thereof. In that case, three intermediate clamp members would be provided, two adjacent intermediate clamp members being pivotally mounted so that the central billets can be gripped by virtue of transmission of the gripping force from an outer clamp member to those central billets.

I claim:

1. A device for cutting into predetermined lengths at least three laterally spaced continuously cast parallel axes metal strands during their downward movement, said device comprising: a carriage mounted for downward movement at the same rate as the strands; strand clamping means on the carriage and strand cutting means positioned on the carriage to cut all the strands when clamped; said strand clamping means comprising a single pair of opposed spaced outer clamping surfaces; means for moving said outer clamping surfaces into operative engagement with said strands, transverse to the axes of the strands; at least two members operatively attached to the carriage; at least one of the carriage attached members pivotally mounted for movement about an axis transverse to the axes of the strands; each of the carriage attached members providing pairs of intermediate clamping surfaces; said two outer and two of the intermediate clamping surfaces defining betweem them two passageways each for vertically receiving one cast metal strand; and said carriage attached members defining between them at least one passageway for receiving a vertically cast metal strand.

2. A device as claimed in claim 1 in which one of said carriage attached members is fixedly attached to the carriage.

3. A device as claimed in claim 1 wherein the outer clamping surfaces comprise a pair of V-shaped jaws.

4. A device as claimed in claim 1 wherein said means for moving the outer surfaces comprises hydraulic means.

5. A device as claimed in claim 1 wherein intermediate clamping surfaces are provided by clamping rolls.

6. A device as claimed in claim 1 wherein intermediate clamping surfaces have radiussed features which contact strands at two vertically separated regions.

7. A device as claimed in claim 2 wherein the pivoted carriage attached members have a pair of clamping rolls which provide intermediate clamping surfaces and said fixed carriage attached member has radiussed regions which contact strands at two vertically separated places to provide intermediate strand clamping means.

8. A device as claimed in claim 1 wherein one of said strand clamping means is provided above the strand cutting means, and another is provided below said strand cutting means.

* * * * *